US005557389A

United States Patent [19]

Sato et al.

[11] Patent Number: 5,557,389

[45] Date of Patent: Sep. 17, 1996

[54] DEVICE FOR SEPARATING A TRANSFER PAPER UTILIZING A SEPARATION VOLTAGE

[75] Inventors: Masaki Sato; Hiroshi Kubota; Kiyoshi Morimoto; Takatoshi Nishimura; Takashi Miyake; Hisaki Shimosaka, all of Osaka, Japan

[73] Assignee: Mita Industrial Co., Ltd., Osaka, Japan

[21] Appl. No.: 323,940

[22] Filed: Oct. 17, 1994

[30] Foreign Application Priority Data

| | | | |
|---|---|---|---|
| Oct. 29, 1993 | [JP] | Japan | 5-271541 |
| Oct. 29, 1993 | [JP] | Japan | 5-271542 |
| Oct. 29, 1993 | [JP] | Japan | 5-271543 |
| Nov. 1, 1993 | [JP] | Japan | 5-272898 |
| Nov. 16, 1993 | [JP] | Japan | 5-286392 |
| Nov. 18, 1993 | [JP] | Japan | 5-288973 |

[51] Int. Cl.[6] ..... G03G 15/14; G03G 21/00

[52] U.S. Cl. ..... 355/315; 271/312

[58] Field of Search ..... 355/221, 219, 355/315; 271/307, 310, 312

[56] References Cited

U.S. PATENT DOCUMENTS

| | | | |
|---|---|---|---|
| 3,620,615 | 11/1971 | Volkers | 355/315 |
| 3,912,257 | 10/1975 | Gibbons | 271/310 |
| 4,260,240 | 4/1981 | Pieper | 355/221 |
| 4,466,729 | 8/1984 | Iwata | 355/221 |
| 4,896,192 | 1/1990 | Kinoshita | 355/315 |
| 4,912,515 | 3/1990 | Amemiya et al. | 355/315 X |
| 5,182,603 | 1/1993 | Yamada | 355/315 X |

FOREIGN PATENT DOCUMENTS

| | | | |
|---|---|---|---|
| 61-26068 | 2/1986 | Japan | 355/315 |
| 1-287589 | 11/1989 | Japan | 355/315 |
| 3-69977 | 3/1991 | Japan | 355/315 |

*Primary Examiner*—Fred L. Braun
*Attorney, Agent, or Firm*—Antonelli, Terry, Stout & Kraus

[57] ABSTRACT

A device for separating a transfer paper, onto which a toner image has been electrostatically transferred from the surface of a photosensitive member, from the surface of the photosensitive member. A separator roller made of an electrically conducting material is disposed close to the photosensitive member. A spacer assures that an appropriate gap is maintained between the photosensitive member and the separator roller. A voltage source which applies an AC voltage or a pulse voltage to the separator roller. The frequency of the applied voltage is selected to be from 200 Hz to 1 KHz or at 20 KHz or higher, and the voltage level can be controlled as a function of the separator roller temperature and/or moisture level or humidity.

12 Claims, 14 Drawing Sheets

DEVICE FOR SEPARATING A TRANSFER PAPER UTILIZING A SEPARATION VOLTAGE

FIELD OF THE INVENTION

The present invention relates to a device for separating a transfer paper that is employed by an image-forming machine such as an electrophotographic copying machine, a printer, a facsimile or the like.

DESCRIPTION OF THE PRIOR ART

An image-forming machine of this type generally employs electrostatic transfer technology by utilizing static electricity in order to transfer toner image formed on the surface of a photosensitive member onto a transfer paper. In the electrostatic transfer technology, the transfer paper is electrostatically adhered to the surface of the photosensitive member and remains adhered to the surface of the photosensitive member even after the toner image has been transferred onto the transfer paper.

The mechanism in which the transfer paper is adhered to the surface of the photosensitive member will now be described with reference to the case where a negatively charged toner is electrostatically transferred, by referring to FIG. 16. When the positive corona discharge is applied by using a transfer discharger from the back surface side (upper side in the drawing) of a transfer paper P that is fed at a moment when the toner T adhered to the photosensitive layer Y of a photosensitive drum X is transferred, the surface of the transfer paper P is charged with positive ions W due to corona discharge. At this time, a negative electric charge is induced on boundary between photosensitive substrate Z and the photosensitive layer Y formed on the surface of the photosensitive drum X. The potential of the transfer paper P at this moment is from several hundreds of volts to several thousands of volts with respect to the photosensitive substrate Z. On the other hand, the positive electric charge imparted at the time of main charging remains on the surface of a portion of the photosensitive layer Y to which the toner T is adhered, and the electrostatic force between the transfer paper P and the photosensitive drum X is weakened due to this positive electric charge. In a portion of the photosensitive layer Y where the toner T does not exist, however, the positive electric charge is removed during the exposure to light, and a negative electric charge is induced by the corona discharge at the time of transfer operation as described above, allowing a large electrostatic force to act between the photosensitive drum X and the transfer paper P. Due to this electrostatic force, the transfer paper P is brought into intimate contact with the surface of the photosensitive drum X, and the intensity of an electric field therebetween is said to reach 100 kV/cm in a portion where the toner T does not exist. This value exceeds the breakdown voltage of an ordinary air gap of 30 kV/cm, but the electric discharge does not take place since the gap is small.

Therefore, the image-forming machine is equipped with a device for separating the transfer paper that is adhered to the surface of the photosensitive member at the time of transfer operation.

As such a separating device, an AC de-electrifying system has generally been put into practical use. According to this AC de-electrifying system, the corona discharge is executed by an AC corona de-electrifying unit from the back surface side of the transfer paper in order to de-electrify the potential on the surface of the transfer paper. The transfer paper that has been de-electrified by the corona discharge separates away from the surface of the photosensitive member due to the repulsive force of its deflection based upon the rigidity and its own weight. However, the separating device which is based upon the above-mentioned AC de-electrification/separation system and which executes the corona discharge involves a problem in generating ozone, which is harmful to the human body, and discharge products such as nitrogen oxides and the like, which adversely affect the photosensitive member.

As a transfer paper separating device, furthermore, for example, Japanese Utility Model Laid-Open Publication No. 188163/1986 discloses a conductor separation system that separates a transfer paper from the photosensitive member by using a photoconducting roller or the like. According to the separating device disclosed in the above publication, an electrically conducting separator roller is disposed close to, or in contact with, the back surface of the transfer paper that is adhered to the surface of the photosensitive member as a result of the transfer operation, and ground potential or a bias voltage is applied to the separator roller so that the transfer paper is separated away from the photosensitive member by the attractive force of the electric charges of the separator roller and the transfer paper. By using the separating device based upon the conductor separation system, however, the toner will be transferred back onto the photosensitive member when a bias voltage of a polarity opposite to that of transfer voltage is applied to the separator roller. With the separator roller simply grounded, furthermore, the attractive force to the transfer paper is so weak that the transfer paper cannot be reliably separated away from the photosensitive member.

In view of such facts, the present applicant has proposed in Japanese Patent Application No. 138430/1993 a device for electrostatically separating a transfer paper in which a separator roller made of an electrically conducting material is disposed close to, or in contact with, a transfer paper that is electrostatically adhered to the surface of the photosensitive member, and an AC voltage or a pulse voltage is applied to the separator roller to de-electrify the transfer paper, so that the transfer paper is separated away from the surface of the photosensitive member by its own weight or by the deflective repulsive force based upon the rigidity of the transfer paper. This technology makes it possible to decrease the amount of products formed by electric charge and to reliably separate the transfer paper from the surface of the photosensitive member without permitting the toner transferred to the transfer paper from being transferred back again onto the photosensitive member.

Through experiment with the above-mentioned separating device in which an AC voltage or a pulse voltage is applied to the separator roller, however, the present inventors have discovered the fact that the image becomes defective due to the frequency and noise generated between the separator roller and the photosensitive member. That is, when the applied voltage has a low frequency, the toner image transferred onto the transfer paper develops defects such as so-called fringes and the like. In an audible range in which the frequency of the applied voltage exceeds a predetermined range, furthermore, there occurs so-called beeping noise which is offensive to the ears.

The separator roller in the above separating device is disposed close to, or in contact with, the photosensitive member. Here, when the gap is narrow, application of the AC voltage or the pulse voltage to the separator roller results in the occurrence of a so-called beeping sound between the separator roller and the photosensitive member. When the gap is large between the photosensitive member and the separator roller, on the other hand, a high voltage must be applied to obtain de-electrifying effect which is necessary for separating the transfer paper. Besides, when the transfer paper comes in contact with the separator roller to which a high voltage is applied, the transferred image is disturbed.

Moreover, since the separator roller in the above separating device is disposed at a position close to the photosensitive member although it is not in contact therewith, the outer peripheral surface of the separator roller has a high possibility of being contaminated with the toner and the like when the transfer papers undergo jamming. When the transfer paper passes over the separator roller of which the outer peripheral surface is contaminated, the toner and the like may adhere to the back surface of the transfer paper, causing the transfer paper to be contaminated. Moreover, when the transfer paper comes into direct contact with the separator roller to which a voltage has been applied, the image at that portion may be disturbed.

The separator roller in the above-mentioned separating device exhibits electric resistance that varies depending upon changes in the temperature and humidity. Accordingly, under certain temperature and/or humidity conditions the discharge efficiency changes, to deteriorate the quality of the transferred image and to lower the separation performance. That is, with an increase in the temperature the separator roller exhibits a decreased electric resistance and further the discharge efficiency increases. When the discharge efficiency exceeds a predetermined range, there occur so-called AC-spots which are image defects in which part of the toner image on the transfer paper is transferred back onto the photosensitive member. On the other hand, a decrease in the temperature of the separator roller causes the electric resistance to increase and the discharge efficiency to decrease, whereby the de-electrifying effect for the transfer paper decreases, and performance for separating the transfer paper decreases, too. Moreover, the separator roller exhibits an electric resistance which substantially changes depending upon the humidity. That is, the separator roller exhibits an electric resistance which substantially decreases with an increase in the humidity, while the electric resistance substantially increases with a decrease in the humidity, and there occurs a phenomenon similar to the above-mentioned phenomenon in the case where the temperature changes.

By using the above-mentioned separating device, furthermore, the transfer paper having a relatively high rigidity can be reliably separated from the surface of the photosensitive member due to the deflective repulsive force based upon the rigidity thereof. In the case of a transfer paper having a low rigidity, however, the de-electrifying must be conducted to a sufficient degree to reliably separate the transfer paper that is adhered to the photosensitive member. For this purpose, a high AC voltage must be applied to the separator roller to remove the electric charge. The AC discharge causes the toner image to vibrate, often resulting in the occurrence of an image defect called image dispersion.

Moreover, since the separator roller in the above separating device is disposed at a position close to the photosensitive member although it is not in contact therewith, the outer peripheral surface of the separator roller is subject to being contaminated with the toner and the like when no paper is passing or when the transfer papers undergo jamming. When the transfer paper passes over the separator roller of which the outer peripheral surface is contaminated, the toner and the like may adhere to the back surface of the transfer paper, causing the transfer paper to be contaminated. Besides, as the electric resistance of the separator roller decreases with an increase in the temperature and humidity, the discharge efficiency increases. Under such a condition, when the transfer paper comes into contact with the separator roller, the image is disturbed.

SUMMARY OF THE INVENTION

A first object of the present invention is to provide a device for separating a transfer paper in which a voltage of a particular frequency is applied to a separator roller in order to prevent the occurrence of image defect and to suppress the generation of noise having an offensive tone.

A second object of the present invention is to provide a device for separating a transfer paper in which a gap between the photosensitive member and the separator roller is set to lie within a predetermined range in order to suppress the generation of noise and to allow the application of a voltage of a small value.

A third object of the present invention is to provide a device for separating a transfer paper in which the transfer paper is prevented from coming into direct contact with the outer peripheral surface of the separator roller in order to prevent, the transfer paper from being contaminated and the image from being disturbed.

A fourth object of the present invention is to provide a device for separating a transfer paper which does not permit the image quality and the separation performance to become deteriorated due to a change in the discharge efficiency as a result of a change in the temperature and/or humidity or moisture level of the separator roller.

A fifth object of the present invention is to provide a device for separating a transfer paper which is capable of reliably separating the transfer paper that is electrostatically adhered to the surface of the photosensitive member while suppressing the generation of ozone that is harmful to the human body, and without impairing the quality of the transferred toner image.

A sixth object of the present invention is to provide a device for separating a transfer paper which is capable of preventing the transfer paper from coming into direct contact with the outer peripheral surface of the separator roller and of preventing the transfer paper from being contaminated and the image from being disturbed.

In order to achieve the above-mentioned first object according to the invention, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member; and a voltage application means which applies an AC voltage or a pulse voltage to said separator roller; wherein the frequency of said applied voltage is selected to be from 200 Hz to 1 KHz.

In order to achieve the above-mentioned first object according to the invention, furthermore, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member; and a voltage application means which applies an AC voltage or a pulse voltage to said separator roller; wherein the frequency of said applied voltage is selected to be 20 KHz or higher.

In order to achieve the above-mentioned second object according to the invention, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member; and a voltage application means which applies an AC voltage or a pulse voltage to said separator roller; wherein the gap between the surface of said photosensitive member and the surface of said separator roller is selected to be from 0.3 mm to 1.2 mm.

In order to achieve the above-mentioned third object according to the invention, there is provided a device for separating a transfer paper, which is electrostatically adhered to the surface of a photosensitive member, from the surface of said photosensitive member comprising:

a separator roller made of an electrically conducting material disposed close to said photosensitive member and a voltage application means which applies a voltage to said separator roller; wherein a linear or a belt-like insulating member is fitted to the outer peripheral surface of said separator roller.

In order to achieve the above-mentioned fourth object according to the invention, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member;

a voltage application means which applies a separation voltage containing an AC component to said separator roller;

a roller temperature detector means for detecting the temperature of said separator roller; and a control means which controls the operation of said voltage application means based upon a temperature signal from said roller temperature detector means.

In order to achieve the above-mentioned fourth object according to the invention, furthermore, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member;

a voltage application means which applies a separation voltage containing an AC component to said separator roller;

a roller humidity or moisture level detector means for detecting the humidity or moisture level of said separator roller; and a control means which controls the operation of said voltage application means based upon a humidity signal from said roller humidity detector means.

In order to achieve the above-mentioned fourth object according to the invention, furthermore, there is provided a device for separating a transfer paper, onto which is electrostatically transferred a toner image formed on the surface of a photosensitive member, from the surface of said photosensitive member comprising:

a separator roller made of an electrically conducting material disposed close to said photosensitive member;

a voltage application means which applies a separation voltage containing an AC component to said separator roller;

a roller temperature detector means for detecting the temperature of said separator roller;

a roller humidity or moisture level detector means for detecting the humidity of said separator roller; and a control means which controls the operation of said voltage application means based upon a temperature signal from said roller temperature detector means and a humidity signal from said roller humidity detector means.

In order to achieve the above-mentioned fifth object according to the invention, there is provided a device for separating a transfer paper, onto which is electrostatically transferred a toner image formed on the surface of a photosensitive member by a transfer electric field, from the surface of said photosensitive member comprising:

a separator roller made of an electrically conducting material disposed close to said photosensitive member; and a separation voltage application means which applies to said separator roller a voltage obtained by superposing a shift bias voltage of a polarity opposite to that of said transfer electric field on an AC voltage or a pulse voltage which is lower than a discharge voltage; wherein an electric field of a polarity opposite to that of said transfer electric field is established between said separator roller and the transfer paper to create a very small amount of electric discharge.

In order to achieve the above-mentioned sixth object according to the invention, there is provided a device for separating a transfer paper, onto which is electrostatically transferred a toner image formed on the surface of a photosensitive member, from the surface of said photosensitive member comprising:

an electrically conducting separation member which is disposed opposite said photosensitive member and to which is applied an AC voltage or a pulse voltage; and a guide member made of an electrically insulating material which is disposed between said electrically conducting separation member and said photosensitive member, with a gap relative to one another, and having a plurality of guide arms.

Other objects and features of the present invention will become obvious from the description mentioned hereinbelow.

DETAILED DESCRIPTION OF THE PREFERRED EMBODIMENTS

Preferred embodiments of a device for separating the transfer paper constituted according to the present invention will now be described in detail with reference to the accompanying drawings.

Figure 1:
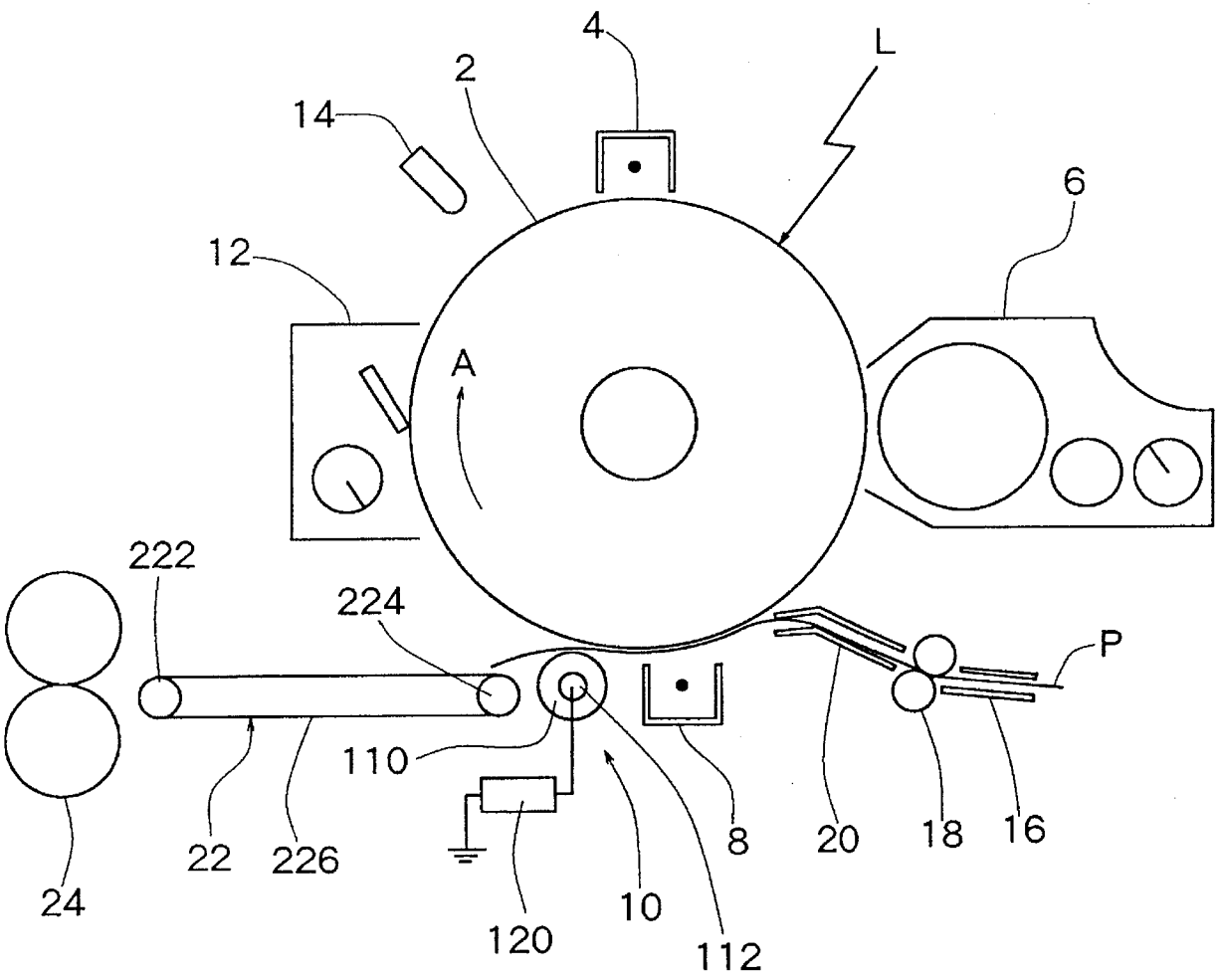
FIG. 1 is a schematic view showing the constitution of an image-forming machine equipped with a separating device according to an embodiment of a first invention.
Figure 2:
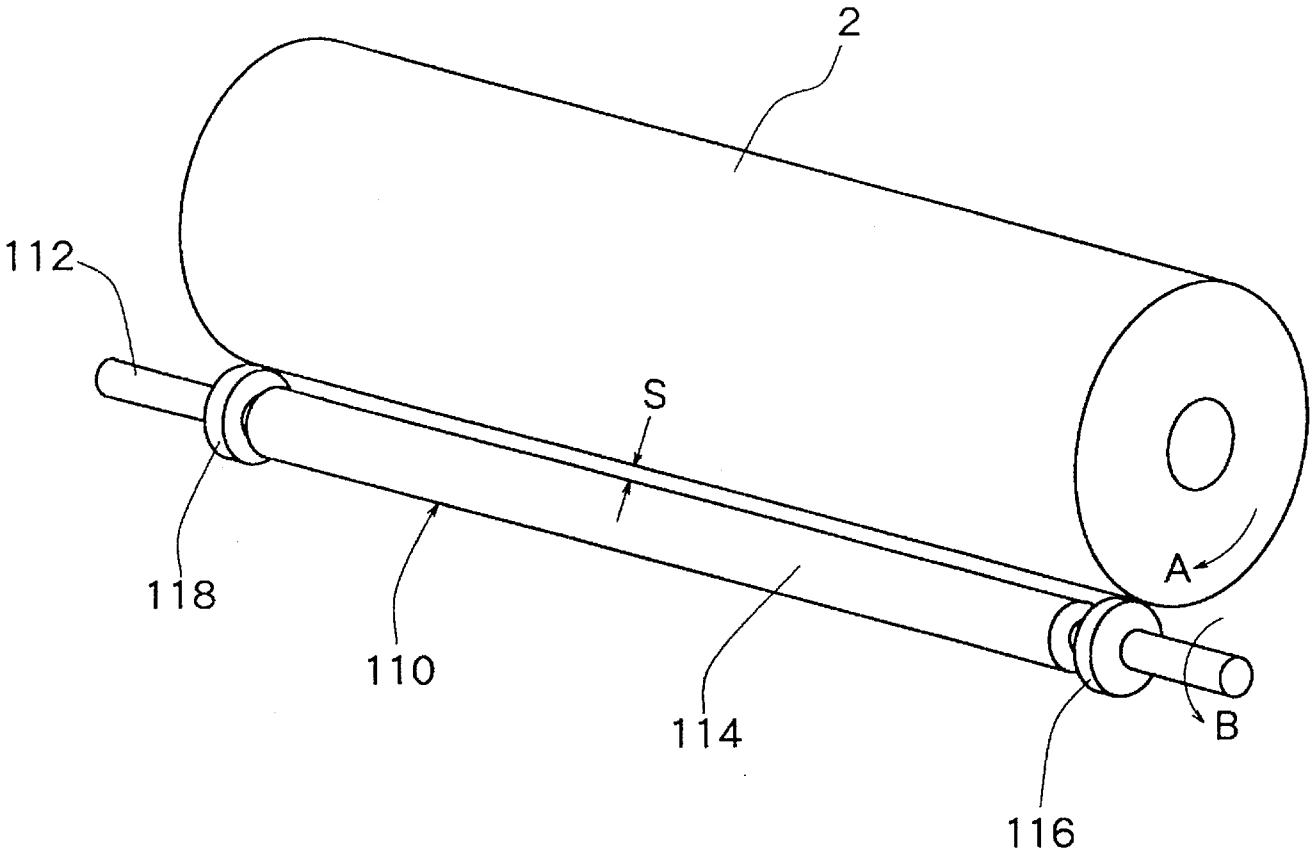
FIG. 2 is a perspective view illustrating a relationship between a photosensitive member and a separator roller that constitutes the separating device according to a first aspect of the present invention.
Figure 3:
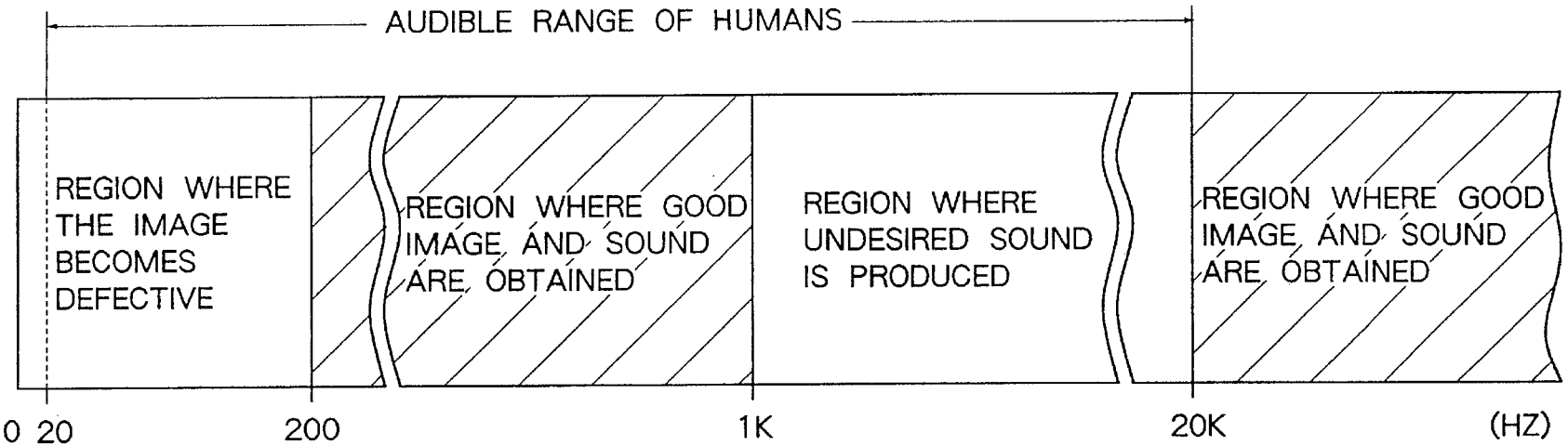
FIG. 3 is an explanatory view showing regions where the image becomes defective and regions where undesired sound is produced relative to the frequency of the applied voltage.

Described below first with reference to FIGS. 1, 2 and 3 is a device for separating the transfer paper according to an embodiment of a first aspect of the present invention.

FIG. 1 is a schematic view showing the constitution of an image-forming machine equipped with a device for separating the transfer paper according to an embodiment of a first aspect of the present invention, FIG. 2 is a perspective view illustrating a relationship between a photosensitive member and a separator roller that constitutes the separating device, and FIG. 3 is an explanatory view showing regions where the image becomes defective and regions where undesired sound is produced relative to the frequency of the applied voltage.

The image-forming machine shown in FIG. 1 is equipped with a photosensitive member 2 made of a photosensitive drum which is rotatably mounted. The photosensitive member 2 is obtained by forming a photosensitive layer of amorphous silicon (a-Si)-based photosensitive material or other photosensitive material on the surface of a metallic tube of a material such as aluminum or the like. Photosensitive member 2 is rotated in the direction of arrow A by a drive unit that is disposed inside the image-forming machine but that is not shown. The photosensitive member 2 is surrounded by a corona discharger 4 for electrification, a developing unit 6, a corona discharger for transfer, a separating device 10 constituted according to the present invention, a cleaning unit 12, and a lamp 14 for de-electrification, as positioned in the direction of rotation indicated by arrow A. Between the corona discharger 4 for electrification and the developing unit 6, the photosensitive member 2 is exposed to light such as laser beam L emitted from an exposure means that is mounted in the image-forming machine but that is not shown. On the upstream side of the corona discharger 8 for transfer are disposed a guide path 16 that serves as a transfer paper feed means for feeding transfer paper between the photosensitive member 2 and the corona discharger 8 for transfer, as well as a pair of resist rollers 18 and a guide path 20. The revolving speed of the pair of resist rollers 18 is so set that the transfer paper P is fed at a peripheral speed which is equal to the peripheral speed of the surface of the photosensitive member 2 that is rotating in the direction of arrow A. On the downstream side of the separating device 10 is disposed a conveyer belt unit 22 that constitutes a transfer paper conveyer means, and a pair of fixing rollers 24 are disposed on the downstream side of the conveyer belt unit 22. The conveyer belt unit 22 comprises a drive roller 222, a driven roller 224 disposed at a distance from the drive roller 222, and a conveyer belt 226 stretched between the drive roller 222 and the driven roller 224.

In the thus constituted image-forming machine, the photosensitive layer on the surface of the photosensitive member 2 is electrically charged substantially uniformly with a predetermined polarity by the corona discharger 4 for electrification while the photosensitive member 2 is being rotated in the direction of arrow A. Then, the surface of the charged photosensitive layer of the photosensitive member 2 is irradiated with a laser beam L in accordance with an image read from a document by the exposure means that is not shown, whereby an electrostatic latent image is formed. Thereafter, the electrostatic latent image on the photosensitive member 2 is developed into a toner image by the developing unit 6. On the other hand, the transfer paper P is conveyed by the pair of resist rollers 18 into a path between the photosensitive member 2 and the corona discharger 8 for transfer. While the transfer paper P conveyed by the pair of resist rollers 18 is in contact with the surface of the photosensitive member 2, the corona discharger 8 for transfer effects, onto the back surface of the transfer paper P, the corona discharge of a polarity opposite to that of the electric charge of the charged toner that is adhered to the photosensitive member 2, whereby the charged toner adhered to the photosensitive member 2 is electrostatically transferred to the surface of the transfer paper P. The transfer paper P onto which the toner image is transferred is separated from the surface of the photosensitive member 2 by the separating device 10. The transfer paper P separated from the surface of the photosensitive member 2 is conveyed by the conveyer belt unit 22 between the pair of fixing rollers 24 where the transfer paper is heated and pressurized so that the toner image is fixed on the surface thereof. The photosensitive member 2 after the above-mentioned step of transfer is brought to the cleaning unit 112 where the toner adhered to the surface of the photosensitive member is removed, and is then irradiated with light for de-electrification emitted from the lamp 14 for de-electrification so that the electric charge is removed from the surface thereof. After having rotated once from the position of the previous electric charging, the photosensitive member 2 is now ready to be electrically charged again.

The separating device 10 mounted on the thus constituted image-forming machine will now be described with reference to FIG. 1 and also to FIG. 2. The separating device 10 according to this embodiment comprises a separating roller 110 and a voltage application means 120 that applies an AC voltage or a pulse voltage to the separating roller 110. Here, the separating roller 110 is constituted by a roller shaft 112 made of a good electrically conducting material such as a metal, a roller member 114 fitted on the roller shaft 112, and positioning rollers 116 and 118 fitted to the roller shaft 112 on both sides of the roller member 114. The roller shaft 112 should be made of a good electrically conducting material having an electric resistance that can be neglected compared with the electric resistance of the material constituting the roller member 114. The roller member 114 is made of an electrically conducting resin material such as a silicone resin and an urethane resin to which are added, for example, a carbon powder or an alkali metal powder, or an electrically conducting rubber, and has a volume electric resistivity ρv of about $1\times10^6$ to $1\times10^{10}$ Ω.cm. The roller member 114 can be fitted on the roller shaft 112 by forcibly fitting a cylindrically formed roller member 114 onto the roller shaft 112 or by setting the roller shaft 112 in a mold and then foam-molding the electrically conducting resin material around the roller shaft. The positioning rollers 116 and 118 are made of an insulating material such as a rubber or a synthetic resin, and have a diameter which is larger by about 1 mm than the diameter of the roller member 114. The positioning rollers 116 and 118 can be fitted onto the roller shaft 112 by the same method as the one carried out for the roller member 114. The thus constituted separator roller 110 is disposed in parallel with the photosensitive member 2 as shown in FIG. 2, and is rotatably supported by a support member that is not shown, in a state where the positioning rollers 116 and 118 are in contact with the surface of the photosensitive member. Therefore, a gap S of about 0.5 mm is formed between the surface of the photosensitive member 2 and the surface of the roller member 114, and the separator roller 110 is rotated in a direction of arrow B by the rotation of the photosensitive member 2 in the direction of arrow A via the positioning rollers 116 and 118. The voltage application means 120 applies an AC voltage or a pulse voltage to the roller shaft 112 of the separator roller 110 via a contact terminal that is not shown. The applied voltage has a frequency of from 200 Hz to 1 KHz or of 20 KHz or higher.

Described below is the function of the device for separating the transfer paper constituted as described above according to the embodiment. The attractive force decreases between the photosensitive member 2 and the transfer paper P when the electric charge is removed from the transfer paper P that is moving while being adhered to the surface of the photosensitive member 2, by applying an AC voltage or a pulse voltage to the separator roller 110 from the voltage application means 120 in the transfer operation. Therefore, the deflective repulsive force of the transfer paper P when it is adhered to the photosensitive member 2 or the weight of the transfer paper P overcomes the attractive force that is weakened, and in consequence, the transfer paper P is peeled off the surface of the photosensitive member 2. FIG. 3 illustrates experimental results showing regions where the image becomes defective and regions where undesired sound is produced relative to the frequency of the applied voltage. When the frequency of the applied voltage is lower than 200 Hz as shown in FIG. 3, defects such as so-called fringes occur on the toner image that is transferred onto the transfer paper. Moreover, so-called a beeping sound is produced in an audible range of a person when the frequency of the applied voltage ranges from 1 KHz to 20 KHz. In a range of from 200 Hz to 1 KHz of the frequency of the applied voltage, no defect occurs on the image, high-pitch sound is not produced and noise is absorbed by the operation sound of the machine and is not offensive. When the frequency of the applied voltage exceeds 20 KHz, no defect occurs on the image and no sound is heard. Accordingly, no defect occurs on the image, and production of the noise of an offensive tone can be suppressed when the frequency of the AC voltage or the pulse voltage applied to the separator roller 110 is set to lie within a range of from 200 Hz to 1 KHz or at 20 KHz or higher.

The device for separating the transfer paper according to a second aspect of the invention will now be described with reference to FIGS. 4 and 5.

Figure 4:
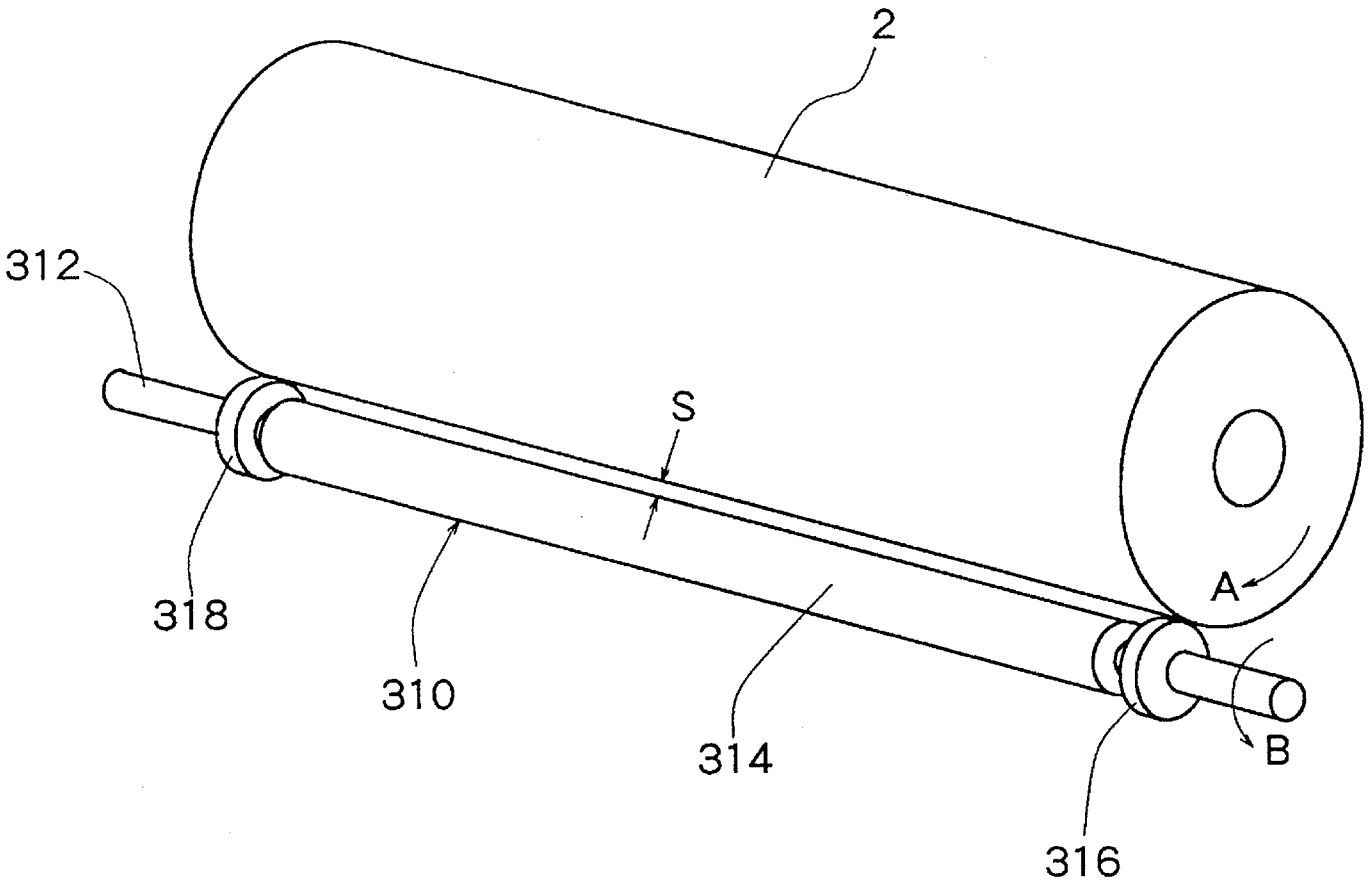
FIG. 4 is a perspective view illustrating a relationship between a photosensitive member and a separator roller that constitutes the separating device according to a second aspect of the invention.
Figure 5:
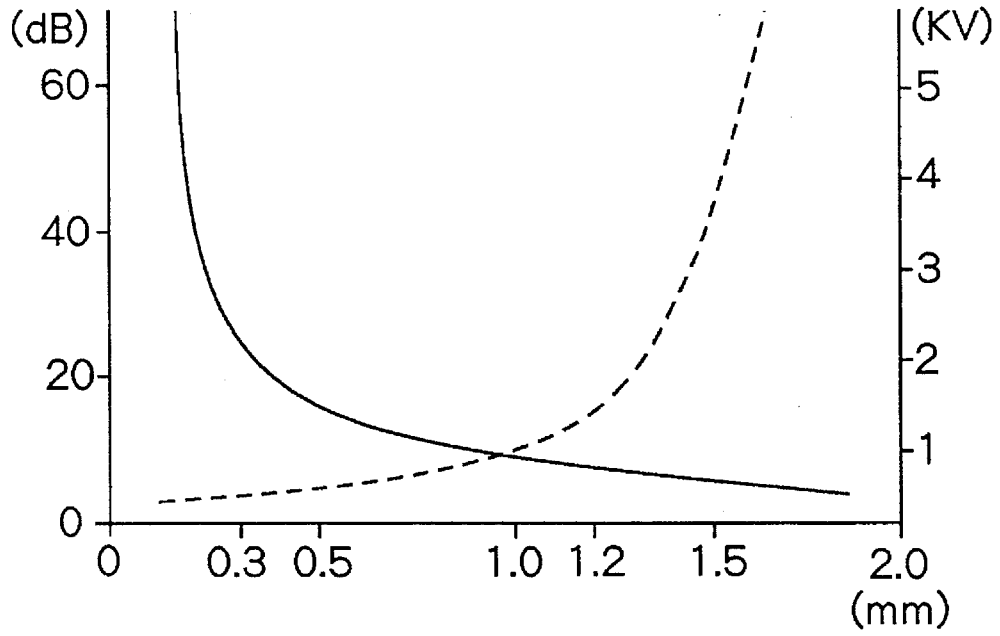
FIG. 5 is a diagram illustrating a relationship between the noise and the required application voltage relative to the gap between the photosensitive member and the separator roller.

FIG. 4 is a perspective view illustrating a relationship between the photosensitive member and the separator roller that constitutes the separating device according to a second aspect of the present invention, and FIG. 5 is a diagram illustrating a relationship between the noise and the required applied voltage relative to the gap between the photosensitive member and the separator roller.

This aspect of the invention specifies the gap between the surface of the photosensitive member and the surface of the separator roller that constitutes the separating device 10 mounted in the image-forming machine shown in FIG. 1.

The separator roller 310 according to the embodiment shown in FIG. 4 is constituted by a roller shaft 312 made of a good electrically conducting material such as a metal, a roller member 314 fitted onto the roller shaft 312, and positioning rollers 316 and 318 fitted to the roller shaft 312 on both sides of the roller member 314. The roller shaft 312, roller member 314 and positioning rollers 316 and 318 that constitute the separator roller 310 are made of the same materials as those constituting the separator roller 110 shown in FIG. 2.

The thus constituted separator roller 310 is supplied with an AC voltage or a pulse voltage from the voltage application means 120 like the case of the separator roller 110 of FIGS. 1 and 2.

FIG. 5 illustrates experimental results showing a relationship of the noise and the required application voltage with respect to the gap S between the surface of the photosensitive member 2 and the surface of the roller member 314. As indicated by the solid line in FIG. 5, the noise increases with a decrease in the gap S and abruptly increases as the gap S becomes smaller than about 0.3 mm. As indicated by the broken line, on the other hand, the applied voltage must be increased with an increase in the gap S and must be abruptly increased as the gap S becomes larger than about 1.2 mm. It will thus be understood that the noise is small when the gap S between the surface of the photosensitive member 2 and the surface of the roller member 314 is larger than about 0.3 mm, and when the gap S is smaller than about 1.2 mm the applied voltage can be about 1 to 2 KV. By setting the gap between the surface of the photosensitive member 2 and the surface of the roller member 314 to be from about 0.3 mm to about 1.2 mm, therefore, the noise is suppressed from being generated and the de-electrification can be achieved to a sufficient degree by the application of a relatively low voltage. With the voltage applied to the separator roller being suppressed to be relatively low as described above, the image is not disturbed even when the transfer paper separated from the surface of the photosensitive member comes into contact with the separator roller.

Described below is a device for separating the transfer paper according to a third aspect of the present invention shown in FIG. 6.

Figure 6:
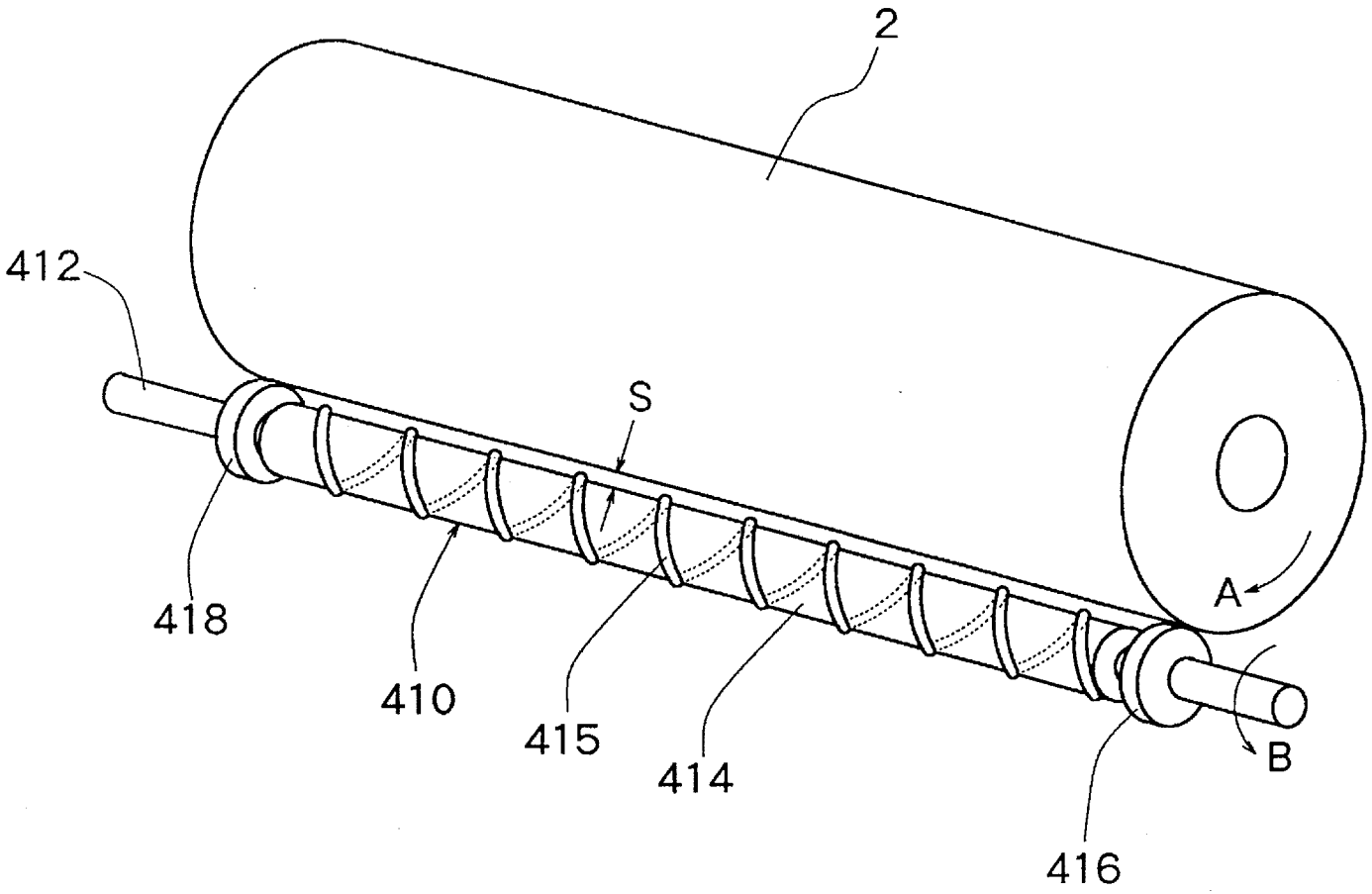
FIG. 6 is a perspective view illustrating a relationship between a photosensitive member and a separator roller that constitutes the separating device according to a third aspect of the present invention.

FIG. 6 is a perspective view illustrating a relationship between the photosensitive member and the separator roller that constitutes the separating device according to the third aspect of the invention.

This invention improves the separator roller that constitutes the separating device 10 mounted in the image-forming machine that is shown in FIG. 1.

The separator roller 410 shown in FIG. 6 is constituted by a roller shaft 412 made of a good electrically conducting material such as a metal, a roller member 414 fitted onto the roller shaft 412, a linear or a belt-like insulating member 415 helically wound on the outer peripheral surface of the roller member 414, and positioning rollers 416 and 418 fitted to the roller shaft 412 on both sides of the roller member 414. The roller shaft 412 should be made of a good electrically conducting material having an electric resistance of a level that can be neglected compared with the electric resistance of the material constituting the roller member 414. The roller member 414 is made of an electrically conducting resin material such as a silicone resin and an urethane resin to which are added, for example, a carbon powder or an alkali metal powder, or an electrically conducting rubber, and has a volume resistivity ρv of about $1\times10^{6}$ to $1\times10^{10}$ Ω.cm. The roller member 414 can be fitted to the roller shaft 412 by forcibly fitting a cylindrically formed roller member 414 onto the roller shaft 412 or by setting the roller shaft 412 in a mold and foam-molding the electrically conducting resin material around the roller shaft. According to this embodiment, the insulating member 415 is made of a linear material having a diameter of about 0.2 to 0.3 mm composed of a synthetic resin such as nylon, polyethylene or the like and is helically wound on and adhered to the outer peripheral surface of the roller member 414. The positioning rollers 416 and 418 are made of an insulating material such as rubber or synthetic resin and have a diameter which is larger by about 1 mm than the diameter of roller member 414. The positioning rollers 416 and 418 are fitted onto the roller shaft 412 by the same method as the one carried out for the roller member 414. The thus constituted separator roller 110 is disposed in parallel with the photosensitive member 2 as shown in FIG. 6, and is rotatably supported by a support member that is not shown, in a state in which the positioning roller 416 is in contact with the surface of the photosensitive member 2. Therefore, a gap S of about 0.5 mm is formed between the surface of the photosensitive member 2 and the surface of the roller member 414, and the separator roller 410 is rotated in a direction of arrow B by the rotation of the photosensitive member 2 in the direction of arrow A via the positioning roller 416.

The thus constituted separator roller 410 is impressed with an AC voltage or a pulse voltage from the voltage application means 120 in the same manner as that of the separator roller 110 of FIGS. 1 and 2.

Described below is the function of the device for separating the transfer paper constituted as described above according to this aspect of the invention. The attractive force decreases between the photosensitive member 2 and the transfer paper P when the electric charge is removed from the transfer paper P that is moving while being adhered to the surface of the photosensitive member 2, by applying an AC voltage or a pulse voltage to the separator roller 410 from the voltage application means 120 in the transfer operation. Therefore, the deflective repulsive force of the transfer paper P of when it is adhered to the photosensitive member 2 or the weight of the transfer paper P overcomes the attractive force that is weakened, and in consequence, the transfer paper P is peeled off the surface of the photosensitive member 2. The separator roller 410 constituting the separating device according to this embodiment is constituted as described above, and an insulating material 415 of a linear synthetic resin material is wound on the outer peripheral surface of the roller member 414. Therefore, the transfer paper P does not come into direct contact with the outer peripheral surface of the roller member 414. Thus, the voltage is not directly applied to the transfer paper P and hence, the image is prevented from being disturbed by the direct application of voltage. Moreover, the transfer paper P does not come into direct contact with the outer peripheral surface of the roller member 414 and is not contaminated even when the toner and the like are adhered to the outer peripheral surface of the roller member 414. The gap between the outer peripheral surface of the roller member 414 and the transfer paper P can be easily adjusted by selecting the diameter or thickness of the insulating member 415.

In the foregoing was described the third aspect of the invention by way of an embodiment shown in FIG. 6. The present invention, however, is in no way limited to these aspects only but can be modified in a variety of ways without departing from the technical scope of the invention, and such modifications should not be excluded from the technical scope of the invention. For instance, though the foregoing descriptions have dealt with separating devices of the type in which the AC voltage or the pulse voltage was applied to the separator roller, the present invention can be further adapted to a conductor separation system which applies ground potential or a bias voltage to the separator roller.

Described below is the device for separating the transfer paper according to a fourth aspect of the present invention shown in FIGS. 7 to 10.

Figure 7:
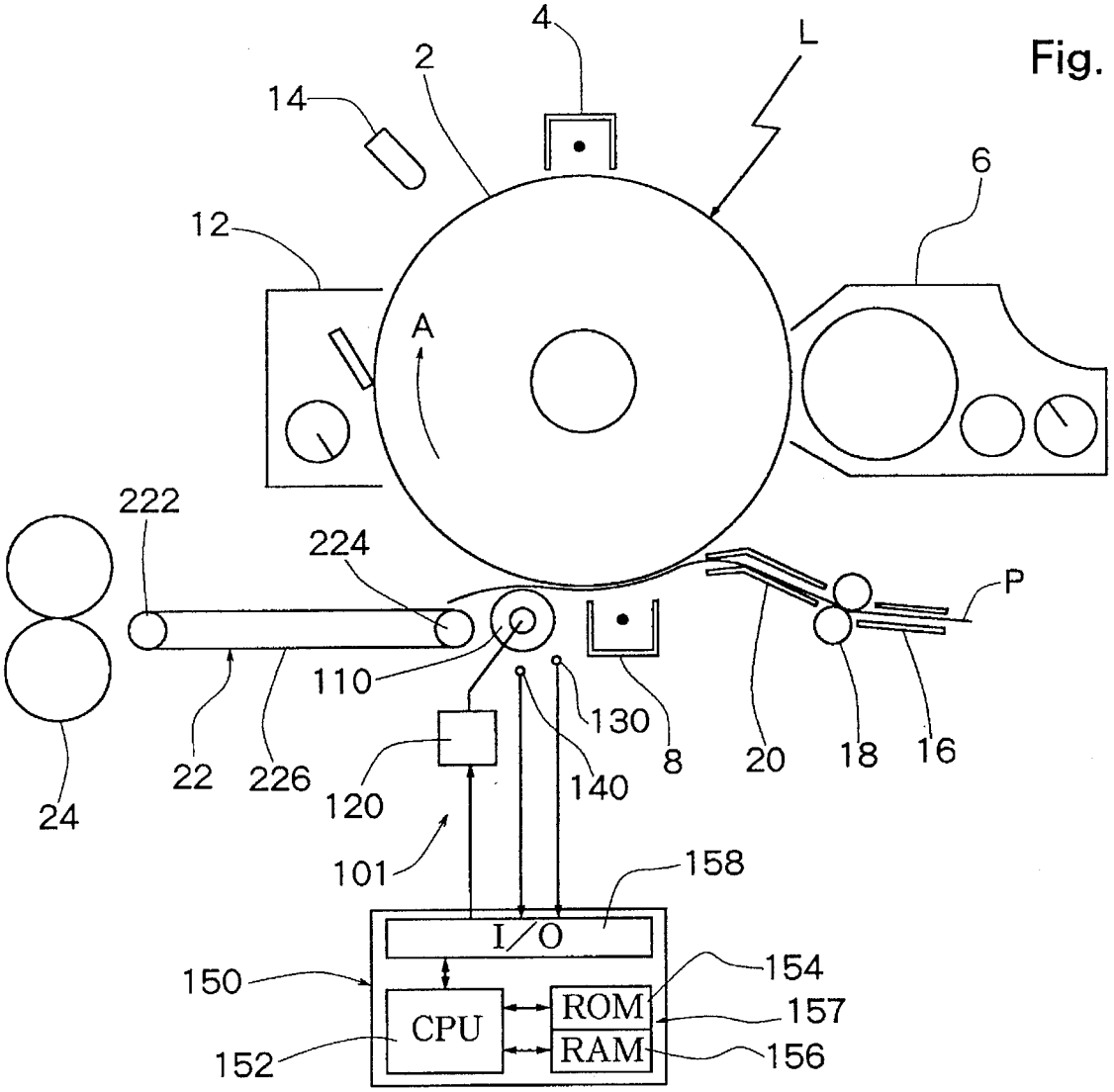
FIG. 7 is a schematic view showing the constitution of an image-forming machine equipped with a separating device according to a fourth aspect of the present invention.
Figure 8:
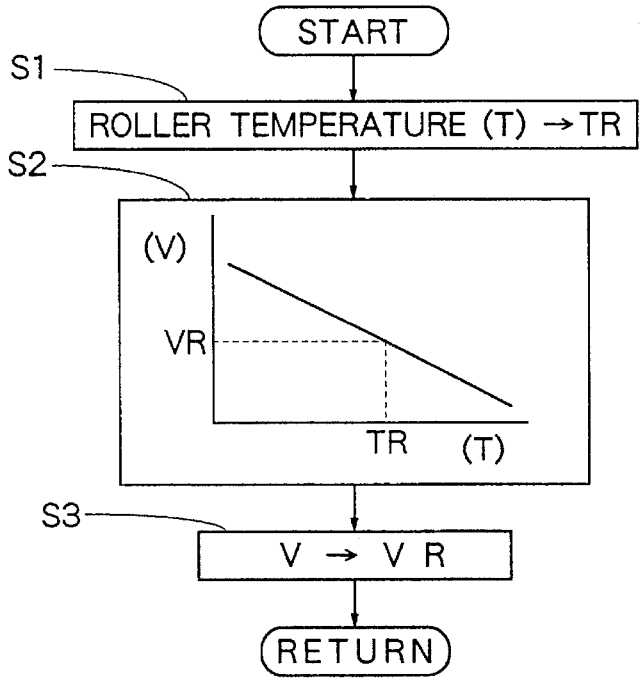
FIG. 8 is a flow chart explaining the operation of the separating device according to the fourth aspect of the invention.
Figure 9:
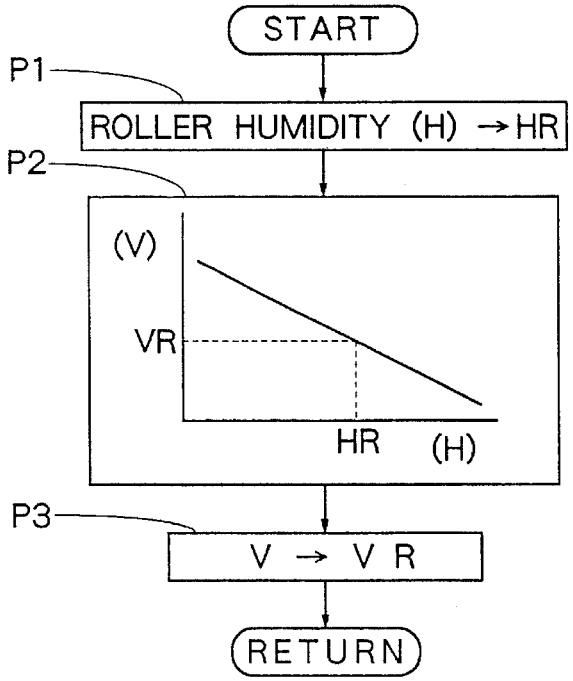
FIG. 9 is a flow chart explaining the operation of the separating device according to another embodiment of the fourth aspect of the invention.
Figure 10:
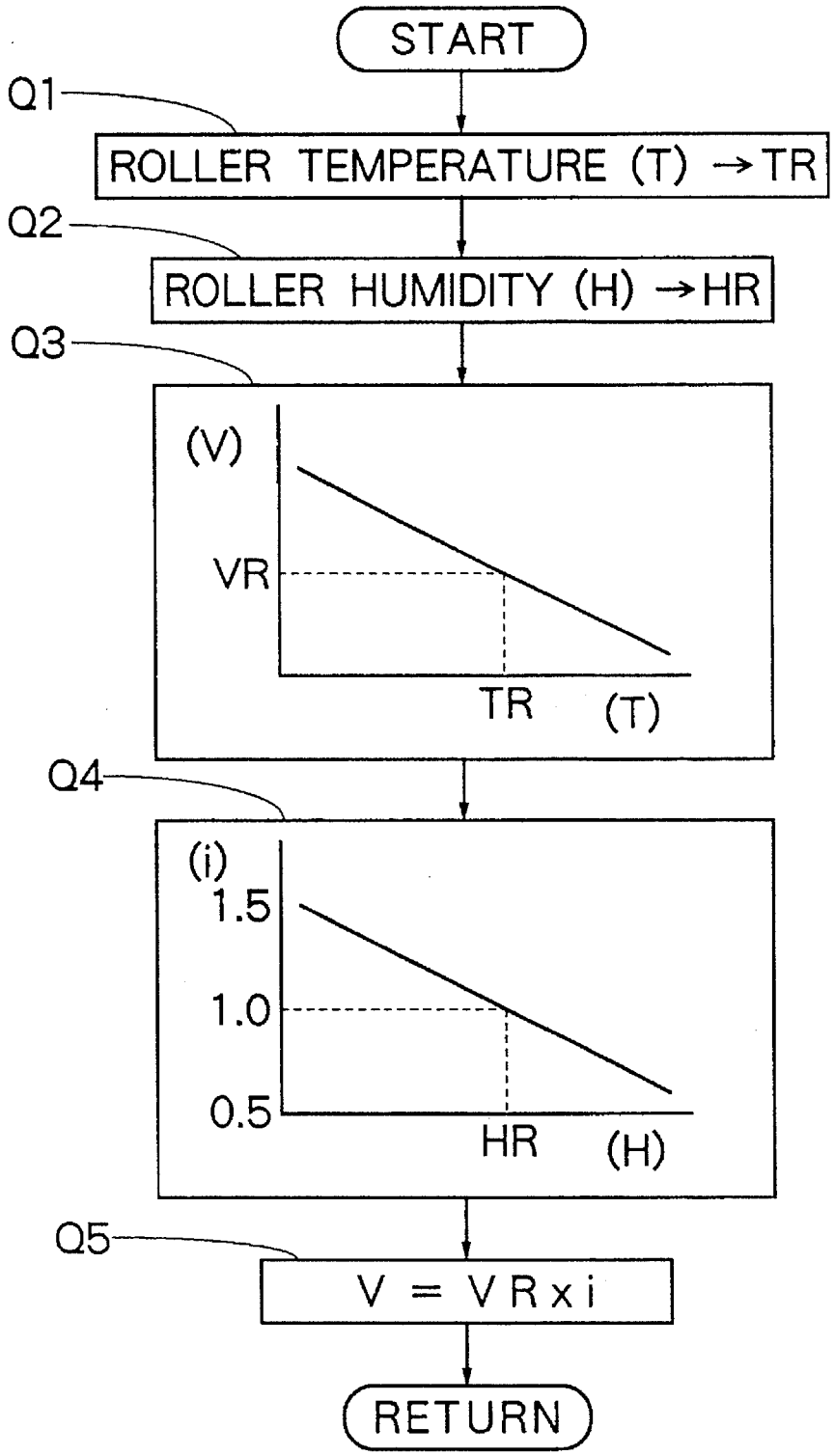
FIG. 10 is a flow chart explaining the operation of the separating device according to a further embodiment of the fourth aspect of the invention.

FIG. 7 is a schematic view showing the constitution of an image-forming machine equipped with the separating device according to of the fourth aspect of the invention, FIG. 8 is a flow chart for explaining the operation of the separating device according to the fourth aspect of the invention, FIG. 9 is a flow chart for explaining the operation of the separating device according to another embodiment of the fourth aspect of the invention, and FIG. 10 is a flow chart for explaining the operation of the separating device according to a further embodiment of the fourth aspect of the invention.

Like the image-forming machine shown in FIG. 1, the image-forming machine shown in FIG. 7 is equipped with a photosensitive member 2 made of a photosensitive drum which is rotatably mounted, as well as a corona discharger 4 for electrification, a developing unit 6, a corona discharger 8 for transfer, a separating device 101 constituted according to the present invention, a cleaning unit 12 and a lamp 14 for de-electrification, all of which are disposed surrounding the photosensitive member 2. Between the corona discharger 4 for electrification and the developing unit 6, the photosensitive member 2 is exposed to light such as laser beam L emitted from an exposure means that is mounted in the image-forming machine but that is not shown. On the upstream side of the corona discharger 8 for transfer are disposed a guide path 16 that serves as a transfer paper feed means for feeding transfer paper between the photosensitive member 2 and the corona discharger 8 for transfer, as well as a pair of resist rollers 18 and a guide path 20. The revolving speed of the pair of resist rollers 18 is so set that the transfer paper P is fed at a peripheral speed which is equal to the peripheral speed of the surface of the photosensitive member 2 that is rotating in the direction of arrow A. On the downstream side of the separating device 101 is disposed a conveyer belt unit 22 that constitutes a transfer paper conveyer means, and a pair of fixing rollers 24 are disposed on the downstream side of the conveyer belt unit 22. The conveyer belt unit 22 comprises a drive roller 222, a driven roller 224 disposed at a distance from the drive roller 222, and a conveyer belt 226 stretched between the drive roller 222 and the driven roller 224.

The thus constituted image-forming machine operates in the same manner as the image-forming machine shown in FIG. 1.

Described below is the separating device 101 mounted in the thus constituted image-forming machine. The separating device 101 according to this embodiment comprises a separator roller 110, a voltage application means 120 for applying a separation voltage containing AC components to the separator roller 110, a roller temperature detector means 130 for detecting the temperature of the separator roller 110, a roller humidity detector means 140 for detecting the moisture level of the separator roller 110, and a control means 150 for controlling the operation of the voltage application means 120 based upon detection signals of the roller temperature detector means 130 and the roller humidity detector means 140.

The separator roller 110 is constructed in the same manner as the separator roller 110 shown FIG. 2 and its details are not described here.

In the transfer operation, the voltage application means 120 is controlled for its operation by the control means 150 and applies a separation voltage containing an AC component to the roller shaft 112 of the separator roller 110 via a contact terminal that is not shown. The separation voltage may be obtained by superposing a shift bias voltage, of a polarity opposite to that of the transfer electric field established by the corona discharger 8 for transfer, on an AC voltage or a pulse voltage, or on an AC voltage or a pulse voltage which is lower than a discharge voltage. It is desired that the roller temperature detector means 130 directly detect the temperature of the roller member 114 (see FIG. 2) of the separator roller 110, but it may detect the temperature of the adjacent atmosphere instead, and it outputs the detection signal to the control means 150. It is desired that the roller humidity detector means 140 directly detect the moisture level of the roller member 114 of the separator roller 110, but it may detect the humidity of the adjacent atmosphere instead, and it outputs the detection signal to the control means 150. The control means 150 is constituted by a microcomputer which comprises a central processing unit 152 that processes the operation according to a control program, a storage means 157 having a ROM 154 for storing the control program and a control map, a RAM 156 for storing the operated results, and an input/output interface 158. The control means 150 inputs detection signals from the roller temperature detector means 130 and the roller humidity detector means 140, calculates the application voltage to be applied to the separator roller 110 based upon the detection signals in compliance with the control program, and controls the operation of the voltage application means 120 based upon the operated results.

The device for separating the transfer paper according to the fourth invention shown in FIG. 7 is constituted as described above, and one embodiment of its function will now be described with reference to the flow chart of FIG. 8. In the transfer operation, the control means 150 inputs at a step S1 a detection signal TR from the roller temperature detector means 130 that detects the roller temperature T, and stores it as a roller temperature in the RAM 156. Then, the control means 150 finds the applied voltage V based on the control map stored in the ROM 154 (step S2). That is, the control map shown in step S2 has previously been stored in ROM 154 based upon experimentally obtained application voltages V corresponding to the roller temperatures T. An application voltage VR corresponding to the detection signal TR as stored in the RAM 156 in step S1 is found from the control map. After the application voltage VR corresponding to the present roller temperature TR is thus found, the operation of the voltage application means 120 is controlled with the voltage V applied to the separator roller 110 set as VR (step S3). As described above, since the application voltage V corresponding to the roller temperature T is applied to the separator roller 110, nearly the same discharge effect can be obtained even when the roller temperature changes and the electric resistance changes. Thus, since the discharge effect does not change, the transferred image is prevented from becoming defective, and performance for separating the transfer paper is prevented from lowering.

FIG. 9 is a flow chart illustrating another embodiment of the fourth aspect of the invention. In this embodiment, the control means 150 in the transfer operation inputs at a step P1 a detection signal HR from the roller humidity detector means 140 that detects the roller humidity or moisture level H, and stores it as a roller humidity in the RAM 156. The control means 150 then finds an application voltage V based on the control map stored in the ROM 154 (step P2). That is, the control map shown in step P2 has previously been stored in ROM 154 based upon experimentally obtained application voltages V corresponding to roller humidity levels or moisture levels H, and an application voltage VR corresponding to the detection signal HR as stored in the RAM 156 in step P1 is found from the control map. After the application voltage VR corresponding to the present roller humidity HR is thus found, the operation of the voltage application means 120 is controlled with the voltage V applied to the separator roller 110 set as VR (step P3). As described above, since the application voltage V corresponding to the roller humidity H is applied to the separator roller 110, nearly the same discharge effect can be obtained even when the roller humidity changes and the electric resistance changes. Thus, since the discharge effect does not change, the transferred image is prevented from becoming defective, and performance for separating the transfer paper is prevented from lowering.

FIG. 10 is a flow chart illustrating a further embodiment of the fourth aspect of the invention. In this embodiment, the control means 150 in the transfer operation inputs at a step Q1 a detection signal TR from the roller temperature detector means 130 that detects the roller temperature T, and stores it as a roller temperature in the RAM 156. The control means 150 further inputs at a step Q2 a detection signal HR from the roller humidity detector means 140 that detects the roller humidity or moisture level H, and stores it as a roller humidity in the RAM 156. The control means 150 then finds the application voltage V based upon the control map stored in the ROM 154 (step Q3). That is, the control map shown in the step Q3 has previously been stored in ROM 154 based upon experimentally obtained application voltages V corresponding to roller temperatures T, and an application voltage VR corresponding to the detection signal TR as stored in the RAM 156 in step Q1 is found from the control map. After the application voltage VR corresponding to the present roller temperature TR is thus found, the control means 150 then finds a correction coefficient i that corresponds to the roller humidity HR based upon the control map stored in the ROM 154 (step Q4). That is, the control map shown in step Q4 has previously been stored in ROM 154 based upon experimentally obtained correction coefficients i that correspond to the roller humidity levels or moisture levels H, and a correction coefficient i corresponding to the detection signal HR as stored in RAM 156 in step Q2 is found from the control map. After the correction coefficient i for the roller humidity is thus found, the application voltage VR corresponding to the roller temperature found at the step Q3 is multiplied by the correction coefficient i to find the application voltage V (step Q5). After the applied voltage V is calculated, the control means 150 controls the operation of the voltage application means 120 and applies the voltage V to the separator roller 110. Thus, the separator roller 110 is supplied with a voltage obtained by correcting the voltage corresponding to the roller temperature by the correction coefficient i corresponding to the roller humidity or moisture level. Accordingly, nearly the same discharge effect is obtained at all times even when the electric resistance changes as a result of a change in the roller temperature and in the roller humidity or moisture level. Since the discharge effect does not change, the transferred image is prevented from becoming defective, and performance for separating the transfer paper is prevented from lowering.

Mentioned below is the device for separating the transfer paper according to a fifth aspect of the present invention in conjunction with FIGS. 11 to 13.

Figure 11:
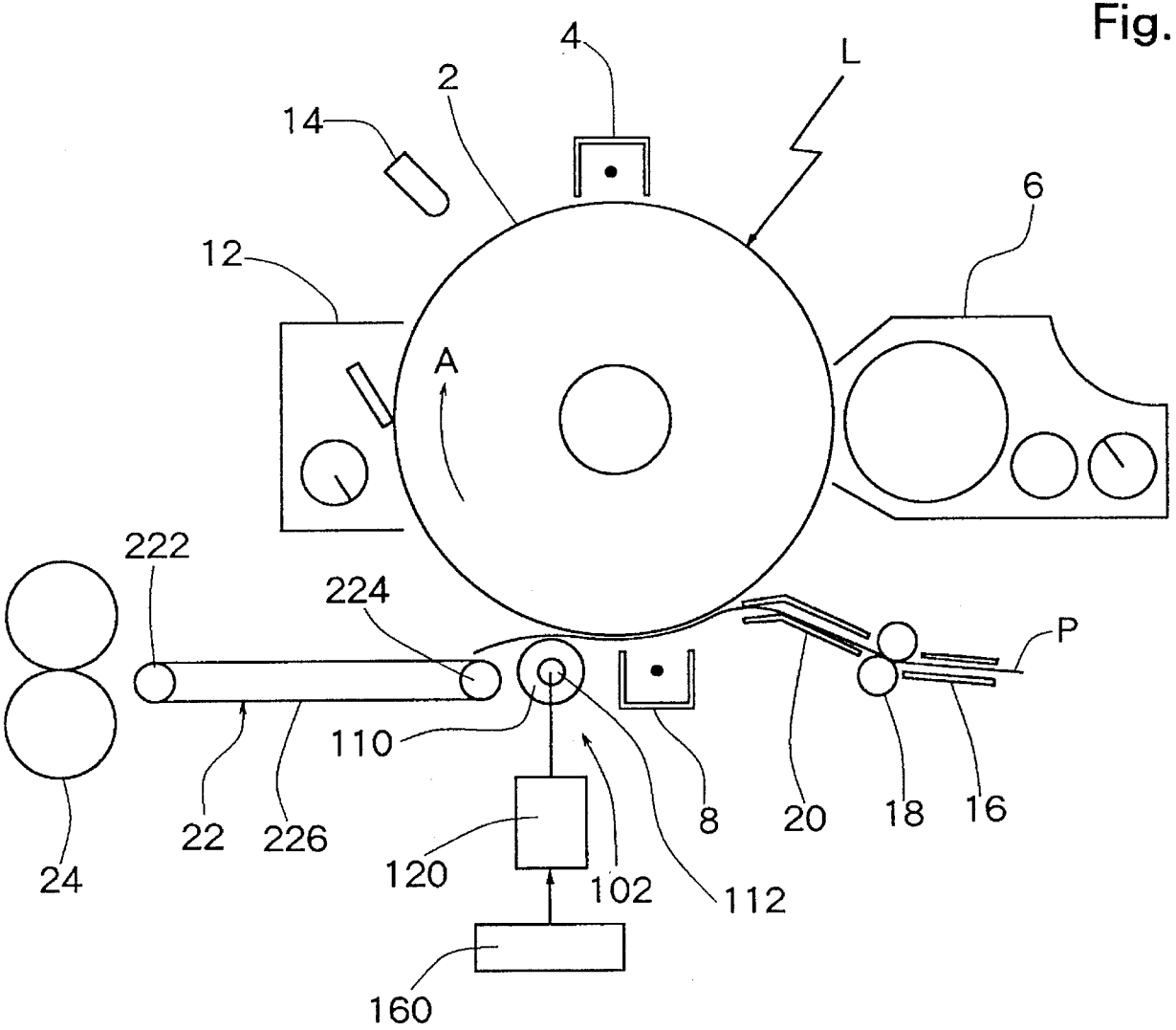
FIG. 11 is a schematic view showing the constitution of an image-forming machine equipped with a separating device according to a fifth aspect of the present invention.
Figure 12:
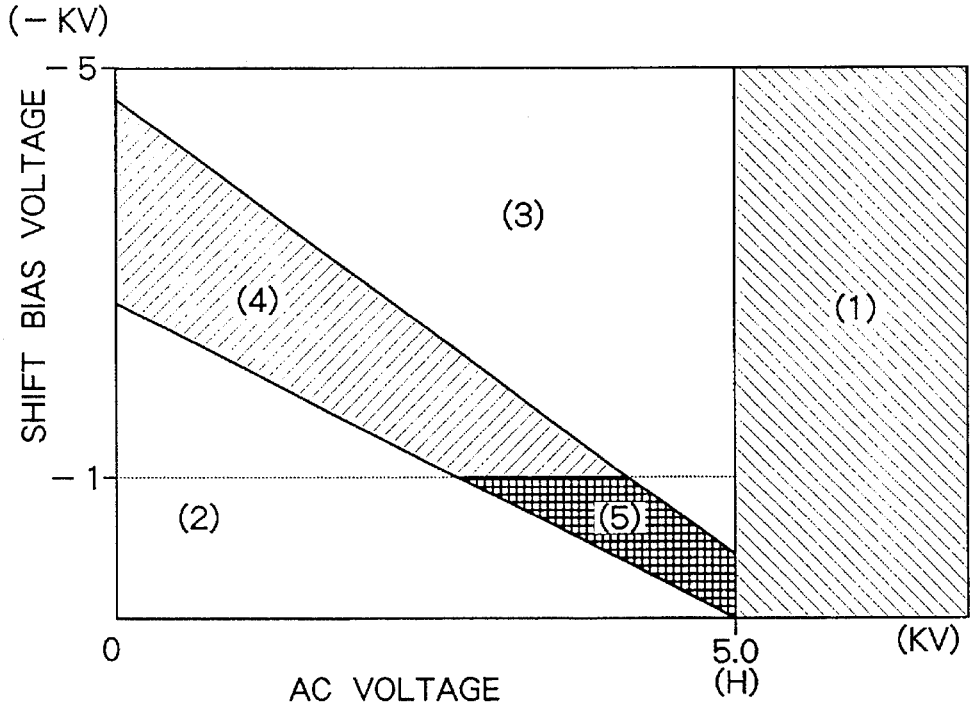
FIG. 12 is a diagram illustrating relationships among the separation performance, image property, shift bias voltage and AC voltage applied to the separator roller that constitutes the separating device according to the fifth aspect of the invention.
Figure 13:
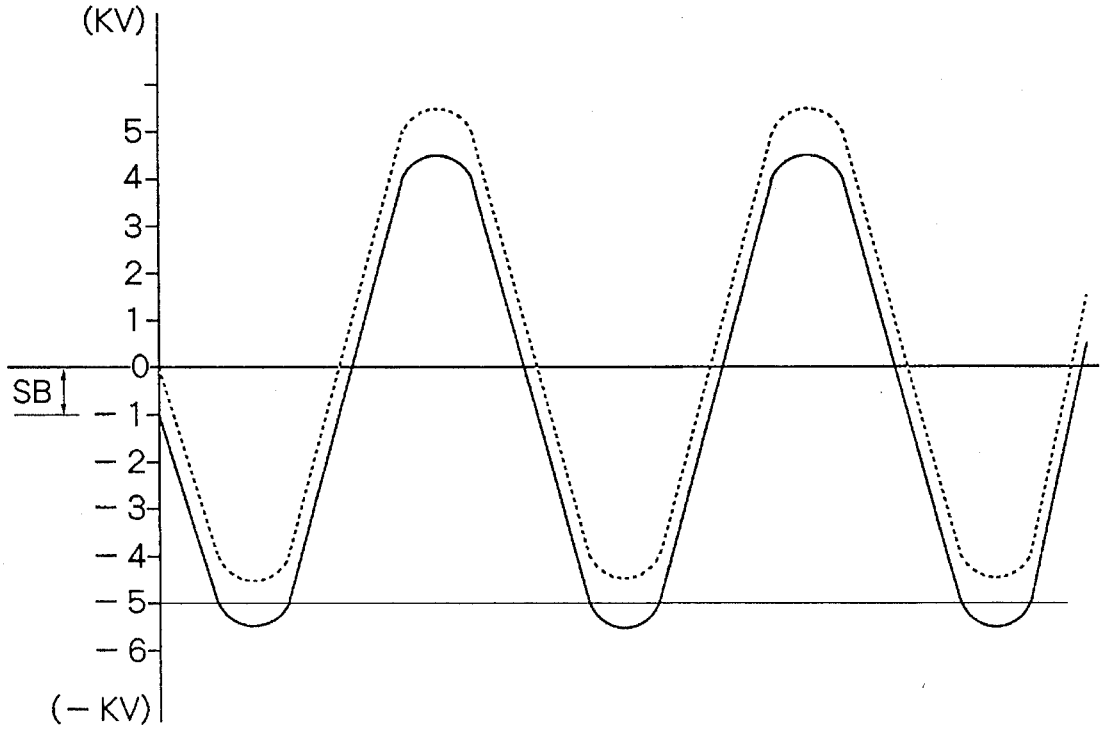
FIG. 13 is a diagram illustrating relationships among the discharge starting voltage, the AC voltage and the shift bias voltage applied to the separator roller.

FIG. 11 is a schematic view showing the constitution of the image-forming machine equipped with the separating device according to the fifth aspect of the invention, FIG. 12 is a diagram illustrating relationships among the separation performance, image property, shift bias voltage and the AC voltage applied to the separator roller that constitutes the separating device according to the fifth aspect of the invention, and FIG. 13 is a diagram illustrating relationships among the AC voltage applied to the separator roller, the shift bias voltage and the discharge starting voltage.

Like the image-forming machine shown in FIG. 1, the image-forming machine shown in FIG. 11 is equipped with a photosensitive member 2 made of a photosensitive drum which is rotatably mounted, as well as a corona discharger 4 for electrification, a developing unit 6, a corona discharger 8 for transfer, a separating device 102 constituted according to the present invention, a cleaning unit 12 and a lamp 14 for de-electrification, all of which are disposed surrounding the photosensitive member 2. Between the corona discharger 4 for electrification and the developing unit 6, the photosensitive member 2 is exposed to light such as laser beam L emitted from an exposure means that is mounted in the image-forming machine but that is not shown. On the upstream side of the corona discharger 8 for transfer are disposed a guide path 16 that serves as a transfer paper feed means for feeding transfer paper between the photosensitive member 2 and the corona discharger 8 for transfer, as well as a pair of resist rollers 18 and a guide path 20. The revolving speed of the pair of resist rollers 18 is so set that the transfer paper P is fed at a peripheral speed which is equal to the peripheral speed of the surface of the photosensitive member 2 that is rotating in the direction of arrow A. On the downstream side of the separating device 102 is disposed a conveyer belt unit 22 that constitutes a transfer paper conveyer means, and a pair of fixing rollers 24 are disposed on the downstream side of the conveyer belt unit 22. The conveyer belt unit 22 comprises a drive roller 222, a driven roller 224 disposed at a distance from the drive roller 222, and a conveyer belt 226 stretched between the drive roller 222 and the driven roller 224.

The thus constituted image-forming machine operates in the same manner as the image-forming machine shown in FIG. 1.

Described below is the separating device 102 mounted in the thus constituted image-forming machine. The separating device 102 according to this embodiment comprises a separator roller 110, a separation voltage application means 120 for applying a separation voltage to the separator roller 110, and a control means 160 for controlling the operation of the separation voltage application means 120.

The separator roller 110 is constructed in the same manner as the separator roller 110 shown in FIG. 2 and its details are not described here.

The separation voltage application means 120 is controlled for its operation by the control means 160 and applies, in the transfer operation, a voltage obtained by superposing a shift bias voltage, of a polarity opposite to that of the transfer electric field established by the corona discharger 8 for transfer, on an AC voltage or a pulse voltage, lower than a discharge starting voltage, to the roller shaft 112 of the separator roller 110 via a contact terminal that is not shown. The discharge starting voltage varies depending upon the gap S between the photosensitive member 2 and the separator roller 110 (see FIG. 2) and the volume resistivity ρv of the roller member 114 (see FIG. 2) of the separator roller 110. For example, in the case where the above gap S is 0.5 mm, the discharge starting voltage is about 3 kV when the volume resistivity ρv of the roller member 114 is about $1\times10^6$ Ω.cm, and is about 5 kV when the volume resistivity ρv of the roller member 114 is about $1\times10^8$ Ω.cm, and is about 7 kV when the volume resistivity ρv of the roller member 114 is about $1\times10^{10}$ Ω.cm. These values change depending upon the temperature and humidity.

Described below are relationships among the AC voltage and shift bias voltage applied to the separator roller 110 by the separation voltage application means 120, and the separation performance and image property, all with reference to the experimental results shown in FIG. 12. The experimental results of FIG. 12 are those obtained by maintaining a gap S of 0.5 mm between the photosensitive member and the separator roller which has a roller member 114 with a volume resistivity ρv of $1\times10^8$ Ω.cm. In FIG. 12, the abscissa represents the AC voltage and the ordinate represents the shift bias voltage of a negative polarity. In a region (1) where an AC voltage which is higher than the discharge starting voltage H (5 kV in this embodiment) is applied and the discharge takes place between the separator roller 110 and the transfer paper P, the transfer paper is reliably de-electrified and good separation performance is obtained. In this region (1), however, the toner image undergoes vibration due to AC discharge and a defect called image dispersion occurs on the image. In a region (2) where the AC voltage is lower than the discharge starting voltage H and the discharge does not take place despite of the application of a shift bias voltage, there is obtained poor separation performance. In a region (3) where the AC voltage is lower than the discharge starting voltage H and amount of electric discharge increases due to the application of a shift bias voltage, the transfer paper is adhered to the photosensitive member and the separation performance is deteriorated since negative ions are imparted to the transfer paper due to the electric discharge of negative polarity, and positive electric charge is induced in the photosensitive member. In regions (4) and (5) where the AC voltage is lower than the discharge starting voltage H and a very small amount of electric discharge takes place due to the application of a shift bias voltage, the transfer paper is reliably separated from the photosensitive member by the attractive force created by a discharge electric field of a polarity opposite to that of the transfer electric field, i.e., created by a discharge electric field in a region of a negative AC component in this embodiment. As the shift bias voltage exceeds −1 kV, furthermore, there takes place the reverse transfer often resulting in the occurrence of a so-called gray irregularity. It is therefore desired to set a determined AC voltage which generates a very small amount of electric discharge in a region where the shift bias voltage applied to the separator roller 110 is smaller than −1 kV.

The device for separating the transfer paper according to the fifth aspect of the invention is constituted as described above. Its operation will now be described. In the transfer operation, the voltage application means 120 which is controlled for its operation by the control means 160 applies to the separator roller 110 a voltage that is obtained by superposing a shift bias voltage of a polarity opposite to that of the transfer electric field created by the corona discharger 8 for transfer on an AC voltage lower than the discharge starting voltage. That is, referring to FIG. 13 in which the discharge starting voltage is 5 kV, when a DC voltage of −1 kV is superposed as a shift bias voltage SB on an AC voltage of 4.5 kV that is indicated by the broken line, there is obtained a voltage waveform indicated by the solid line in the drawing, and there takes place a very small amount of electric discharge in a negative region of the AC component in a portion where the discharge starting voltage of −5 kV is exceeded. Therefore, an electric field is established between the separator roller 110 and the transfer paper P to create a very small amount of electric discharge, and this acts upon and attracts the transfer paper P that moves due to being adhered to the surface of the photosensitive member 2, so that the transfer paper P is reliably separated from the surface of the photosensitive member 2. According to the present invention, furthermore, the electric discharge takes place only in a region of a polarity opposite to that of the transfer electric field. Therefore, the toner image does not vibrate, unlike when the electric discharge is executed by the AC voltage only, and there does not occur the defective image called image dispersion. According to the present invention, furthermore, since the electric field for creating a small amount of electric discharge of a polarity opposite to that of the transfer electric field contains an AC component, the toner image on the transfer paper is prevented from being transferred back onto the photosensitive member, unlike the case of where the transfer paper is separated by using the DC component only. According to the present invention, moreover, the electric discharge takes place in a very small space only between the separator roller and the photosensitive member and, hence, ozone is produced in very small amounts compared with the conventional corona discharge that occurs in all 360-degree directions.

Though the above-mentioned embodiment has employed a voltage obtained by superposing a shift bias voltage of a polarity opposite to that of the transfer electric field on an AC voltage as a separation voltage that is applied to the separator roller, it is also allowable to use a pulse voltage in place of the above-mentioned AC voltage.

Next, described below is the device for separating the transfer paper according to a sixth aspect of the present invention shown in FIGS. 14 and 15.

Figure 14:
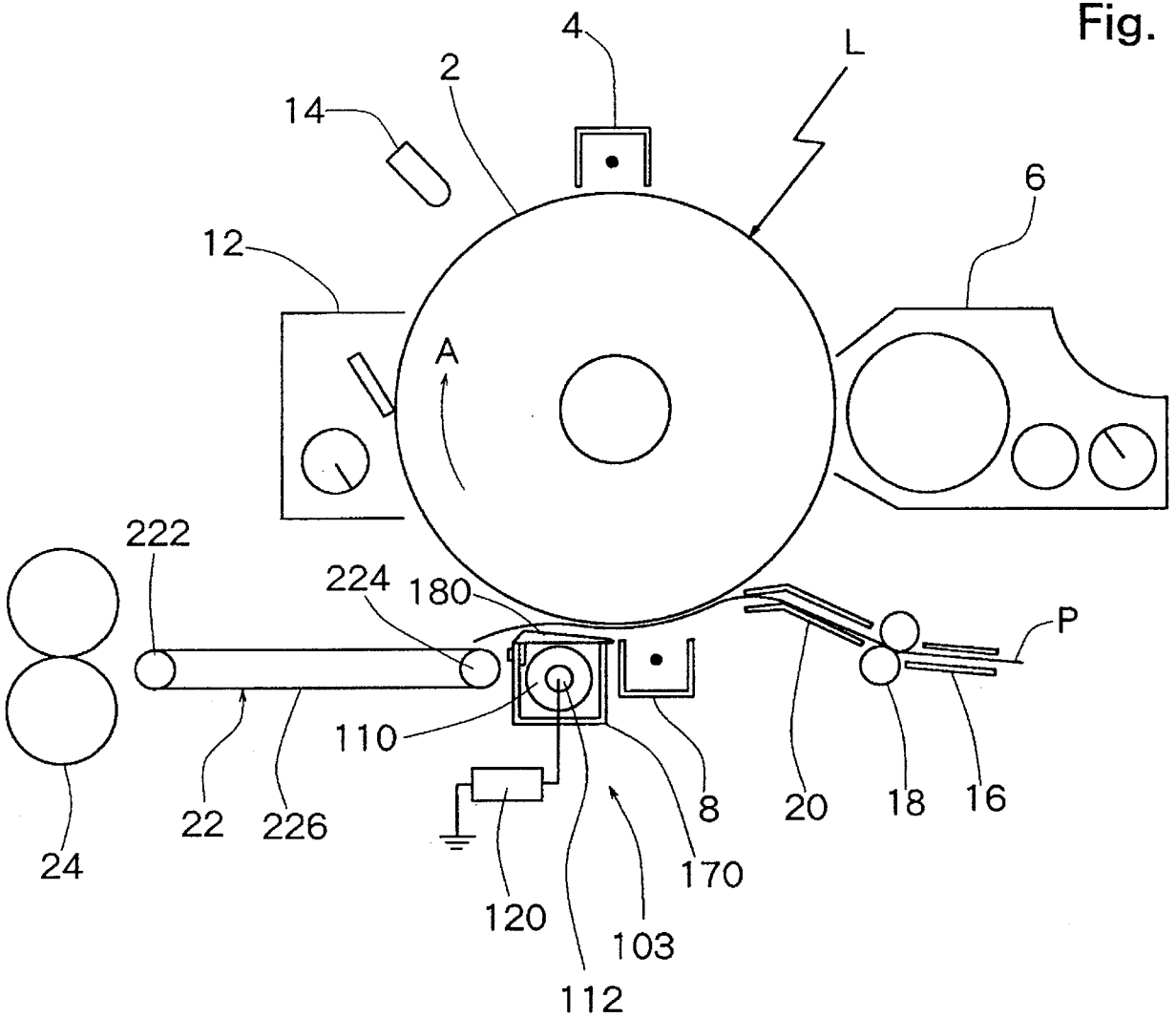
FIG. 14 is a schematic view showing the constitution of an image-forming machine equipped with the separating device according to a sixth aspect of the present invention.
Figure 15:
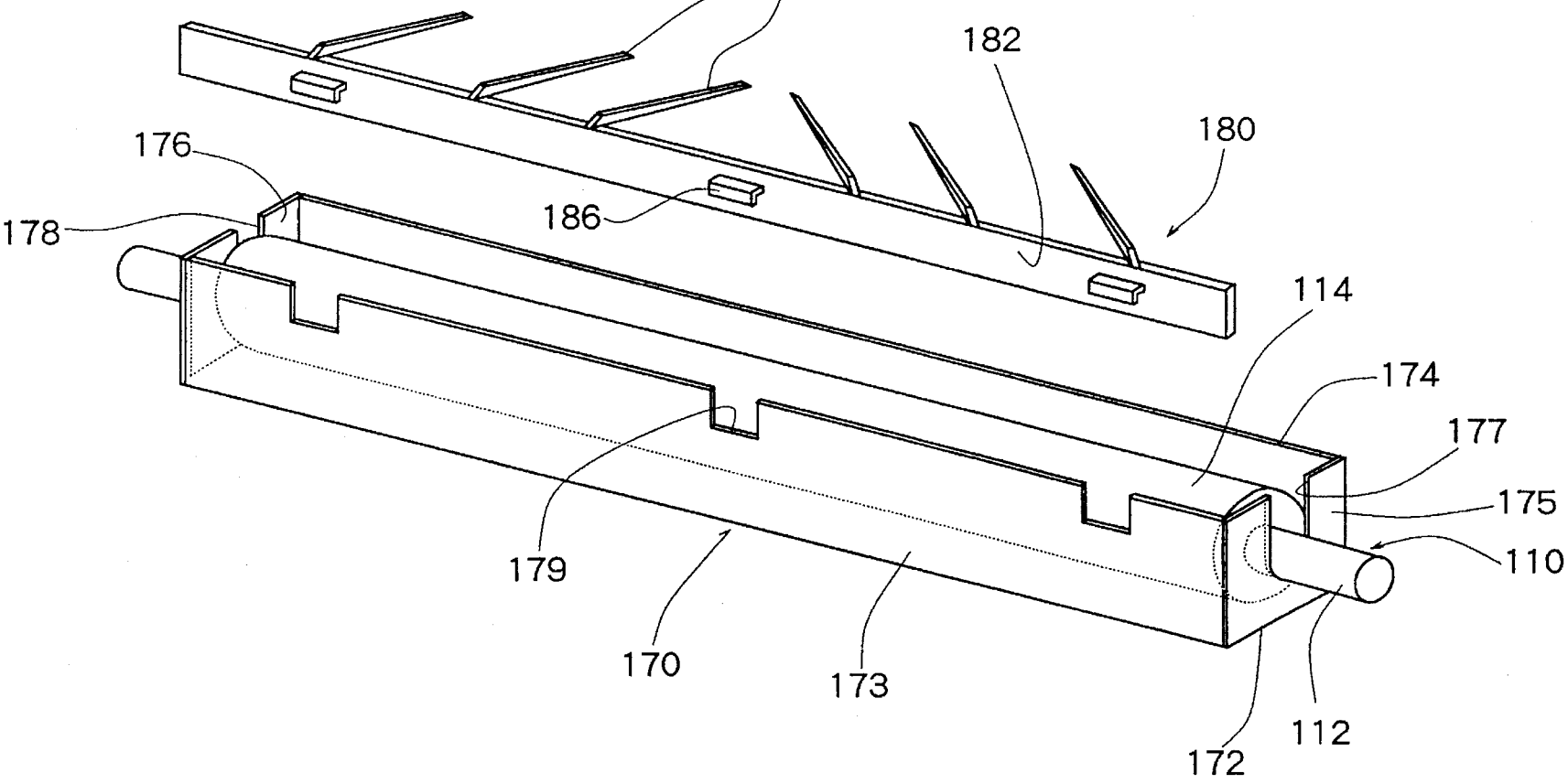
FIG. 15 is a perspective view illustrating major portions of the separating device according to the sixth aspect of the invention.
Figure 16:
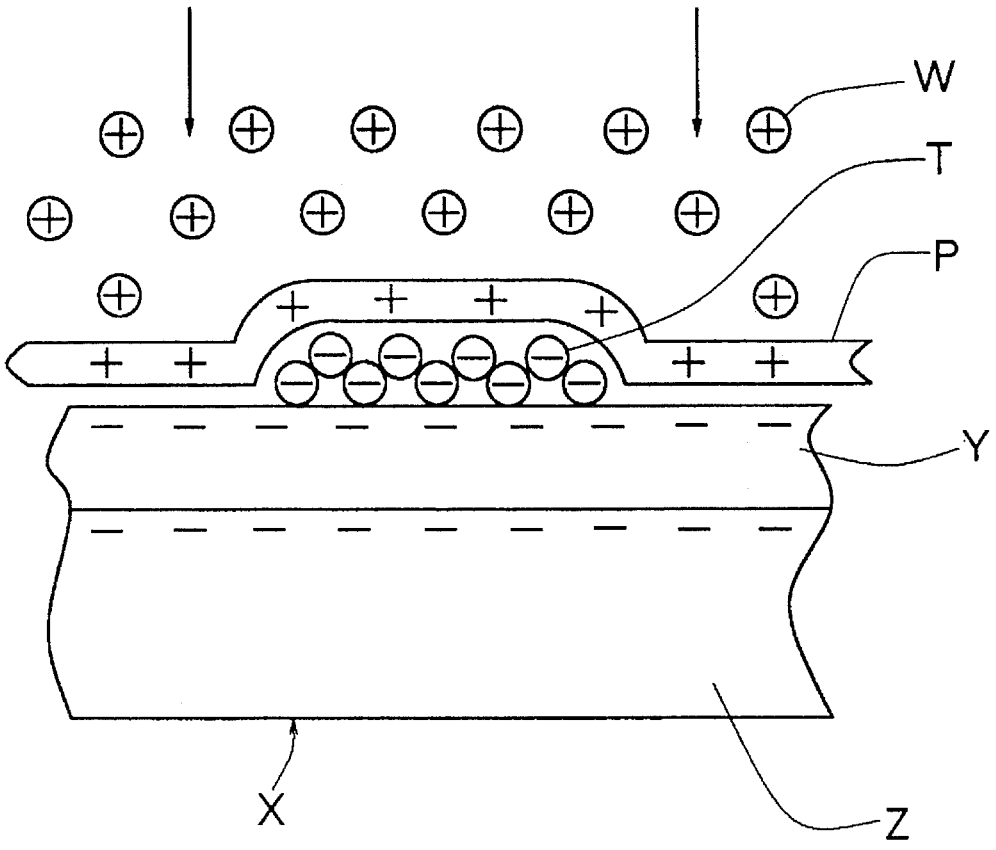
FIG. 16 is a view explaining the mechanism of electrostatic transfer.

FIG. 14 is a schematic view showing the constitution of the image-forming machine equipped with the separating device according to the sixth aspect of the invention, and FIG. 15 is a perspective view illustrating major portions of the separating device according to the sixth aspect of the invention in a disassembled manner.

The image-forming machine shown in FIG. 14 is the same as the image-forming machine shown in FIG. 1 except for the separating device 103 of the sixth invention. Therefore, the same members are denoted by the same reference numerals but their description is omitted.

The separating device 103 shown in FIGS. 14 and 15 comprises a separator roller 110 that constitutes an electrically conducting separation member, a shielded case 170 for containing the separator roller 110, a guide member 180 mounted on the upper end of the shielded case 170, and a voltage application means 120 for applying an AC voltage or a pulse voltage to the separator roller 110.

The separator roller 110 constituting the electrically conducting separation member is constructed in the same manner as the separator roller 110 shown in FIG. 2 and its details are not described here.

The separator roller 110 is accommodated in the shielded case 170 which comprises a rectangular bottom wall 172, side walls 173 and 174 that extend substantially perpendicularly from both sides of the bottom wall 172, and end walls 175 and 176 that close both ends of the bottom wall 172 and the side walls 173, 174. The shielded case 170 is open in the upper portion thereof. Notches 177 and 178 are formed in the end walls 175 and 176 that constitute the shielded case 170, and the roller shaft 112 of the separator roller 110 is fitted in the notches 177 and 178 so as to be rotatably supported. Furthermore, a plurality of engaging grooves 179 are formed in the upper end of one side wall 173 of the shielded case 170, and the guide member 180 is fitted to the engaging grooves 179. The guide member 180 has a support portion 182, a plurality of guide arms 184 of which the ends on one side are disposed on the upper end of the support portion 182 at a distance relative to each other and having their ends on the other side tilted toward the inside, and a plurality of engaging portions 186 formed on the side surface of the support portion 182 at positions corresponding to the engaging grooves 179. These parts are molded together as a unitary structure using an electrically insulating synthetic resin. The thus constituted guide member 180 is fitted to the shielded case 170 with its support portion 182 being disposed along the inner surface of the one side wall 173 of the shielded case 170 and with its engaging portions 186 being engaged with the engaging grooves 179. The guide member 180 mounted on the one side wall 173 of the shielded case 170 is so constituted that the ends on the other side of the guide arms 184 come into contact with the upper end of the other side wall 174. Therefore, the guide arms 184 of the guide member 180 are disposed between the separator roller 110 and the photosensitive member 2, and the transfer paper P separated from the photosensitive member 2 does not come into direct contact with the separator roller 110. During the transfer operation, the voltage application means 120 applies an AC voltage or a pulse voltage to the roller shaft 112 of the separator roller 110 via a contact terminal that is not shown.

The device for separating the transfer paper according to this aspect of the invention is constituted as described above, and described below is the function thereof. In the transfer operation, the transfer paper P that is moving, being adhered to the surface of the photosensitive member 2, is de-electrified by applying an AC voltage or a pulse voltage from the voltage application means 120 to the separator roller 110, so that the attractive force decreases between the photosensitive member 2 and the transfer paper P. Therefore, the deflective repulsive force of the transfer paper P when it is adhered to the photosensitive member 2 or its own weight exceeds the attractive force that is weakened, and the transfer paper P peels off the surface of the photosensitive member 2. Here, the separating device according to this embodiment is provided with the guide member 180 that has a plurality of guide arms 184 arranged at a distance on the upper end of the shielded case 170 that contains the separator roller 110 which constitutes an electrically conducting separator. Therefore, the transfer paper P separated from the photosensitive member 2 moves along the guide arms 184 without coming into contact with the separator roller 110. Accordingly, the transfer paper is not contaminated, despite the toner being adhered to the outer peripheral surface of the separator roller 110. Even in case the discharge efficiency is improved as a result of an increase in the temperature and humidity and a decrease in the electric resistance of the separator roller 110, the image is not disturbed, since the transfer paper does not come into direct contact with the separator roller 110.

What we claim is:

1. A device for separating a transfer paper, onto which a toner image has been electrostatically transferred from the surface of a photosensitive member, from the surface of the photosensitive member, said device comprising:

a separator roller made of an electrically conducting material and adapted to be disposed close to the photosensitive member; and voltage application means for applying an AC voltage or a pulse voltage to said separator roller at a frequency of 20 KHz or higher.

2. A device for separating a transfer paper, which is electrostatically adhered to the surface of a photosensitive member, from the surface of the photosensitive member, said device comprising:

a separator roller made of an electrically conducting material and adapted to be disposed close to the photosensitive member;

voltage application means for applying a voltage to said separator roller; and a linear insulating member fitted around the outer peripheral surface of said separator roller.

3. A device for separating a transfer paper according to claim 2, wherein said separator roller comprises a roller shaft made of a good electrically conducting material, a roller member made of an electrically conducting material fitted onto said roller shaft, and positioning rollers made of an insulating material fitted to said roller shaft on both sides of said roller member and having a diameter slightly larger than the diameter of said roller member, said linear insulating member being fitted onto the outer peripheral surface of said roller member.

4. A device for separating a transfer paper according to claim 2, wherein said linear insulating member is helically wound around the outer peripheral surface of said separator roller.

5. A device for separating a transfer paper, onto which a toner image has been electrostatically transferred from the surface of a photosensitive member, from the surface of the photosensitive member, said device comprising:

a separator roller made of an electrically conducting material and adapted to be disposed close to the photosensitive member;

voltage application means for applying a separation voltage containing an AC component to said separator roller;

roller temperature detector means for detecting the temperature of said separator roller; and control means for controlling said voltage application means based upon the temperature detected by said roller temperature detector means.

6. A device for separating a transfer paper according to claim 5, wherein said control means includes storage means for storing a control map specifying application voltages corresponding to detected roller temperatures.

7. A device for separating a transfer paper, onto which a toner image has been electrostatically transferred from the surface of a photosensitive member, from the surface of the photosensitive member, said device comprising:

a separator roller made of an electrically conducting material and adapted to be disposed close to the photosensitive member;

voltage application means for applying a separation voltage containing an AC component to said separator roller;

roller humidity detector means for detecting the moisture level of said separator roller; and control means for controlling said voltage application means based upon the moisture level detected by said roller humidity detector means.

8. A device for separating a transfer paper according to claim 7, wherein said control means includes storage means for storing a control map specifying application voltage corresponding to detected roller moisture levels.

9. A device for separating a transfer paper, onto which a toner image has been electrostatically transferred from the surface of a photosensitive member, from the surface of the photosensitive member, said device comprising:

a separator roller made of an electrically conducting material and adapted to be disposed close to the photosensitive member;

voltage application means for applying a separation voltage containing an AC component to said separator roller;

roller temperature detector means for detecting the temperature of said separator roller;

roller humidity detector means for detecting the moisture level of said separator roller; and control means for controlling said voltage application means based upon the temperature detected by said roller temperature detector means and the moisture level detected by said roller humidity detector means.

10. A device for separating a transfer paper according to claim 9, wherein said control means includes storage means for storing a first control map specifying application voltages corresponding to detected roller temperatures and a second control map specifying correction coefficients corresponding to detected roller moisture levels, and means for determining an application voltage corresponding to a detected temperature, determining a correction coefficient corresponding to a detected moisture level, and means for controlling said voltage application means based upon the determined application voltage.

11. A device for separating a transfer paper, onto which a toner image has been electrostatically transferred from the surface of a photosensitive member, from the surface of the photosensitive member by use of a transfer electric field, said device comprising:

a separator roller made of an electrically conducting material and adapted to be disposed close to the photosensitive member;

separation voltage application means for superposing a shift bias voltage of a polarity opposite to the polarity of the transfer electric field onto an AC voltage or a pulse voltage which is lower than a discharge starting voltage, and applying the resulting superposed voltage to said separator roller; and means for establishing an electric field, of a polarity opposite to that of the transfer electric field, between said separator roller and the transfer paper to create a very small amount of electric discharge.

12. A device for separating a transfer paper according to claim 11, wherein said separation voltage application means sets the shift bias voltage to a voltage level not higher than 1 KV.

* * * * *